United States Patent [19]

Horton

[11] 4,124,239

[45] Nov. 7, 1978

[54] WING WINDOW LOCK

[76] Inventor: Jack H. Horton, 8050 NE. Central, Minneapolis, Minn. 55432

[21] Appl. No.: 805,139

[22] Filed: Jun. 9, 1977

[51] Int. Cl.[2] ..... E05C 3/04

[52] U.S. Cl. ..... 292/210; 292/DIG. 6

[58] Field of Search ..... 292/108, 153, 154, 210, 292/211, 285, 286, DIG. 6, DIG. 9

[56] References Cited

U.S. PATENT DOCUMENTS

| | | | |
|---|---|---|---|
| 289,973 | 12/1883 | Burd | 292/286 |
| 402,492 | 4/1889 | Thomas | 292/153 |
| 645,113 | 3/1900 | Markham | 292/153 |
| 785,710 | 3/1905 | Cannon et al. | 292/210 |
| 918,316 | 4/1909 | Harris | 292/153 |
| 2,151,934 | 3/1939 | Parrott | 292/DIG. 6 X |
| 2,374,394 | 4/1945 | Tessier | 292/210 X |
| 2,873,769 | 2/1959 | Turtletaub | 292/288 |
| 2,931,676 | 4/1960 | Wroughton | 292/211 |
| 3,428,349 | 2/1969 | Shelton | 292/288 |
| 3,652,112 | 3/1972 | Panelli | 292/DIG. 6 X |

FOREIGN PATENT DOCUMENTS

| | | | |
|---|---|---|---|
| 1,556,828 | 12/1968 | France | 292/288 |
| 4,283 of | 1896 | United Kingdom | 292/210 |

*Primary Examiner*—Thomas J. Holko
*Attorney, Agent, or Firm*—S. Pal Asija

[57] ABSTRACT

A swing wing motor vehicle window lock has a bracket which is fastened to the glass pane of the window. A lock bar and a swing wing are pivotally connected to the bracket having axes of rotation perpendicular to each other. The swing wing has a pin which fits snugly into a bore in the lock bar in two opposite positions, one for window open and another for window locked position.

9 Claims, 6 Drawing Figures

WING WINDOW LOCK

SUMMARY

It is frequently desirable to make motor vehicles theft proof which carry expensive portable equipment. Many times a burglar uses entry into the motor vehicle through the wing window. Motor vehicles such as trucks have generally two such windows in the front of the motor vehicle via one on the driver side and one on the passenger side. The locking arrangement that such windows are equipped with by the manufacturer are often weak and can be accessed easily.

It is an objective of this invention to provide a means for securing swing wing windows, such that they cannot be pried open from outside.

Another objective of this invention is durability beyond the life the the swing wing window or the vehicle to which it is attached.

Another objective of this invention is that the device be portable, and lend itself to easy installation.

Another objective of the invention is that the device be easily adjustable to avoid obstructing the view of the driver.

Other objectives may reside in the simplicity, strength, mode of construction, installation and operation as will be evident from the following description.

The devices of the prior art such as LATIB — U.S. Pat. No. 3,722,935; Pease — U.S. Pat. No. 2,153,206; Parrot — U.S. Pat. No. 2,151,934; McKeen — U.S. Pat. No. 2,168,677; Simpson — U.S. Pat. No. 2,196,478; Meyer — U.S. Pat. No. 2,837,362; Lane — U.S. Pat. No. 2,484,514; and Brown — U.S. Pat. No. 2,033,104 do not meet all of the objectives of this invention enumerated above.

These devices of the prior art are comlex in mode of construction, installation and operation and do not provide the degree of security required. Furthermore these devices use combination of mechanical parts substantially different from the unique combination in the invention of the applicant.

DETAILED DESCRIPTION OF THE PREFERRED EMBODIMENT

Figure 1:
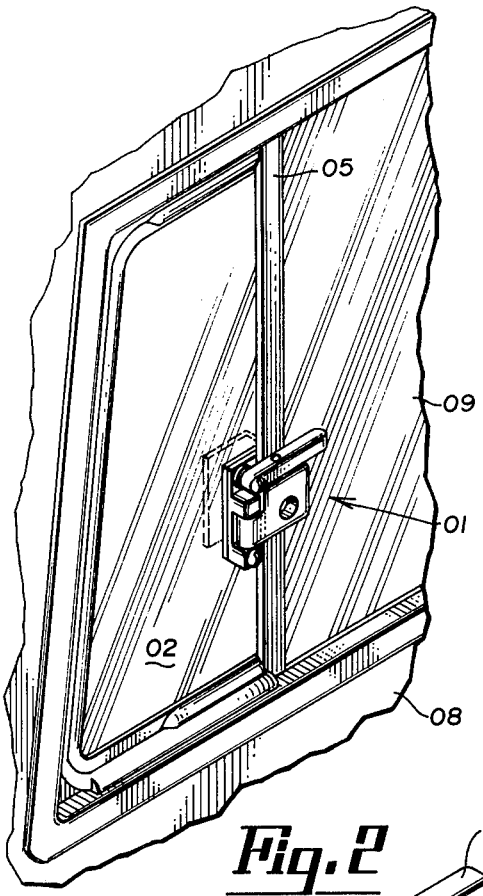
FIG. 1 is a pictorial view of the wing window lock of this invention as mounted on a swing wing window of a motor vehicle as viewed from inside.
Figure 3:
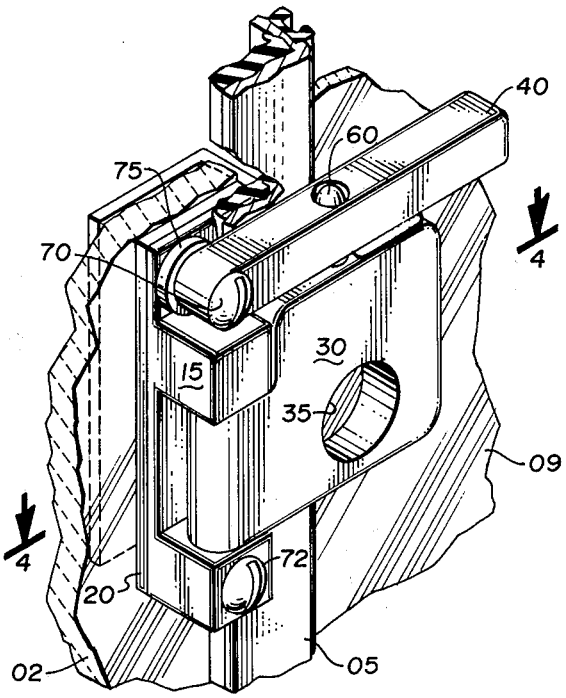
FIG. 3 is a close up pictorial view of figure one with enlarged scale for the device.
Figure 2:
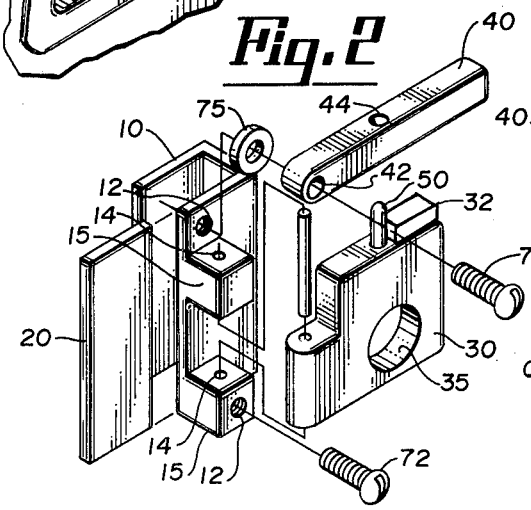
FIG. 2 is an exploded view of the invention of this device showing detailed parts thereof.
Figure 5:
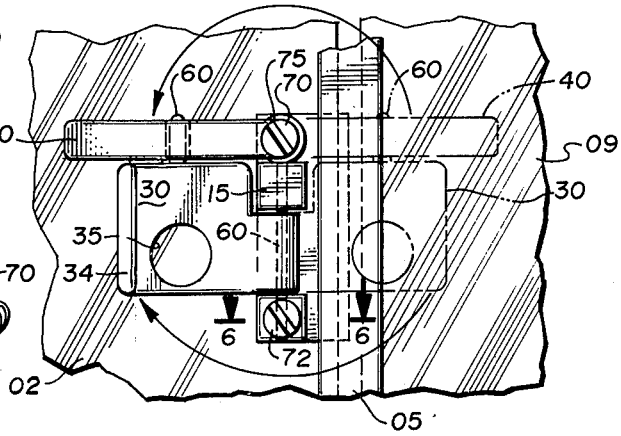
FIG. 5 is an elevation of the device of this invention.
Figure 4:
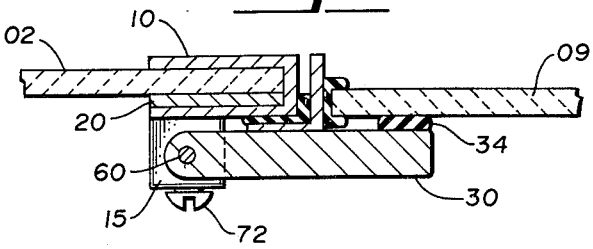
FIG. 4 is a sectional plan view taken along lines '4—4' of FIG. 3.
Figure 6:
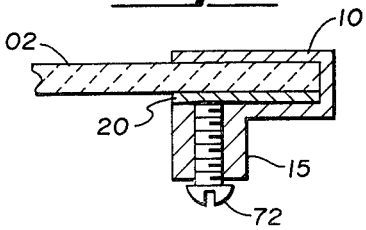
FIG. 6 is a sectional plan view taken along lines '6—6' of FIG. 5.

The swing wing no draft ventilator window lock 01 of this invention comprises a 'U' shaped body bracket or glass attachment 10 which is fastened around glass of the window 02 such that the edge of the glass is recessed into the cavity of the bracket 10. The bracket has plurality of screw holes 12 and plurality of axle holes 14, positioned in a straight line on plurality of projections 15. A spring or tension plate 20 is inserted between the glass attachment 10 and the glass 02 of the ventilator window 05 mounted on a motor vehicle body 08 adjacent to up and down window 09 as shown in FIG. 1. The purpose of tension plate 20 is to avoid cracking of the window by distributing pressure of fasteners over a wider area. A swing wing 30 having a finger hole 35 and an axle hole 36 is designed to fit within the dimensions of projections 15. Two rubber pads 32 and 34 are also attached to swing wing 30. The purpose of the rubber pad 32 is to avoid rattling of the lock when the window and the lock are in the unlocked position and the motor vehicle is running. The purpose of the rubber pad 34 is to lock the adjacent 'up and down' sliding window 09 by providing additional and tight friction between the glass and the swing wing 30 via rubber pad 34 as shown in FIG. 2. A lock bar 40 having two holes 42 and 44 is designed for attachment to body bracket 10. These holes 42 and 44 are on different and perpendicular axis to each other. The hole 44 snugly fits over a fat pin 50 mounted on said swing wing 30. The swing wing 30 is attached to body bracket 10 via an axle 60. The body bracket 10 is attached to glass window with two screws 70 and 72, with said pressure plate 20 inserted between the glass 02 and the body bracket 10 only on the side of the screws 70, 72. The screw 70 is also used as an axle for connecting lock bar 40 to body bracket 10. A washer 75 is also inserted between lock bar 40 and body bracket 10, to facilitate rotation of the lock bar 40 with the screw 70 as axle. The device is made in pairs, one to fit on the driver's side and the other to fit on the passenger's side. The only difference in construction is the orientation of the cavity in body bracket 10 such that with identical installation procedure and identical parts, the lock bar 40 and the pin 50 are at the top and cavity of body bracket 40 is facing the front of the motor vehicle.

Following is a listing of the components used in the preferred embodiment arranged in the ascending order of reference numerals.

01 = Wing window lock of this invention.
02 = Glass of the wing window.
05 = Wing window.
08 = Wall of the body of the motor vehicle.
09 = Adjacent up and down sliding window.
10 = Body bracket-glass attachment.
12 = Mounting holes in body bracket.
14 = Axle holes.
15 = Body bracket projection.
20 = Spring or tension plate or pressure plate.
30 = Swing Wing.
32 = Rubber pad to avoid ratteling.
34 = Rubber pad to lock up and down sliding window.
35 = Finger hole in swing wing 30.
36 = Axle hole in swing wing 30.
40 = Lock bar or latch bar.
42 = Axle cum screw hole in lock bar 40.
44 = Hole in lock bar 40 for pin 50 on swing wing 30.
50 = A projection pin on lock bar 30.
60 = Axle for connecting swing wing 30 to body bracket 10.
70 = Axle cum screw.
72 = Screw.
75 = Washer.

OPERATION

Assume the window and the lock are in the unlocked position. The window is pulled inwards by inserting a finger in hole 35 provided for this purpose in the body of the swing wing 30. When the window 02 is closed, the finger is released from the hole and the swing wing 30 is swiveled to the side of the adjacent 'up and down' sliding window. Likewise lock bar 40 is swung over to the swing wing 30 till the hold 44 snugly fits over the pin 50. It should be noted that swing wing 30 and lock bar 40 rotate on different and perpendicular axes. To unlock the window the reverse procedure is used till the swing wing 30 and the lock bar 40 are in the 180° opposite direction and the pin 60 is in the hole 44 from the opposite direction.

The applicant claims:

1. A swing wing window lock for no draft ventilator windows on motor vehicles, boats and the like comprising;

(a) a body bracket glass attachment;

(b) fastener means for attaching said body bracket glass attachment to the glass of said ventilator window;

(c) a lock bar having a bore pivotally connected to said body bracket glass attachment;

(d) a swing wing also pivotally connected to said body bracket glass attachment; whereby said lock bar has lock means to lock said swing wing in a plurality of positions;

(e) said lock means comprising a projection pin on said swing wing having a shape similar to and circumference somewhat smaller than the inner circumference of said bore, positioned on said swing wing so (as to) that said pin may fit snugly into said bore when said swing wing is in a plurality of positions.

2. A swing wing window lock for no draft ventilator windows of motor vehicles, boats, etc. of claim 1 wherein the axis of rotation of said lock bar and axis of rotation of said swing wing are perpendicular to each other.

3. A swing wing window lock for no draft ventilator windows of motor vehicles, boats or the like of claim 2 wherein said fastener means is an axle for pivotally connecting said lock bar to said body bracket glass attachment.

4. A swing wing window lock for no draft ventilator windows on motor vehicles comprising:

(a) a body bracket glass attachment having a 'U' shaped cavity to mate with an edge of said ventilator window;

(b) a fastener means for attaching said body bracket glass attachment to said ventilator window;

(c) a swing wing connected to said body bracket glass attachment via a first axle;

(d) a projection pin attached to said said swing wing;

(e) a lock bar for locking the swing wing, said lock bar having a bore of shape and size similar to but somewhat larger than the circumference of said projection pin positioned to mate with said projection pin when said swing wing is in a plurality of positions;

(f) a pressure plate inserted between said body bracket glass attachment and said ventilator window; and (g) a second axle for connecting said lock bar to said body bracket glass attachment.

5. A swing wing window lock for no draft ventilator windows on motor vehicles of claim 4 wherein said pressure plate is inserted only on one side of the glass between said ventilator window and said fastener means.

6. A swing wing window lock of no draft ventilator windows on motor vehicles of claim 4 wherein the plane of rotation of said lock bar and plane of rotation of said swing wing are perpendicular to each other.

7. A swing wing window lock for no draft ventilator windows of motor vehicles of claim 4 wherein said fastener means for attaching said body bracket glass attachment to said ventilator window is a screw which also serves as said second axle for pivotally connecting said lock bar to said body bracket glass attachment.

8. A swing wing window lock for no draft ventilator windows on motor vehicles, boats or the like comprising:

(a) a 'U' shaped bracket with a cavity larger than the width of the pane of said ventilator window;

(b) an axle mounting means attached to said 'U' shaped bracket;

(c) plurality of fasteners for mounting said 'U' shaped bracket on an edge of said ventilator window pane;

(d) a swing wing pivotally mounted with a first axle positioned in said axle mounting means;

(e) a projection pin attached to said swing wing; and (f) a lock bar for lockably engaging said swing wing, said lock bar pivotally connected to said 'U' shaped bracket via an axle defined by one fastener of said plurality of (screws) fasteners for mounting said 'U' shaped bracket to said ventilator window pane.

9. A swing wing window lock for no draft ventilator windows of motor vehicles, or the boats or the like of claim 8 wherein:

(a) said lock bar has a bore of shape similar to and size somewhat larger than said projection pin; and wherein (b) said axle interconnecting said lock bar to said 'U' shaped bracket is perpendicular to axle interconnecting said swing wing to said 'U' shaped bracket.

* * * * *